US007789195B2

(12) United States Patent
Mabuchi et al.

(10) Patent No.: US 7,789,195 B2
(45) Date of Patent: Sep. 7, 2010

(54) MUFFLER OF INTERNAL COMBUSTION ENGINE

(75) Inventors: Tomoki Mabuchi, Toyota (JP); Norihiko Sawada, Toyota (JP); Fumihiko Mizuno, Inazawa (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 617 days.

(21) Appl. No.: 11/630,169

(22) PCT Filed: Jan. 12, 2006

(86) PCT No.: PCT/JP2006/000681

§ 371 (c)(1),
(2), (4) Date: Dec. 20, 2006

(87) PCT Pub. No.: WO2006/095495

PCT Pub. Date: Sep. 14, 2006

(65) Prior Publication Data

US 2008/0035420 A1 Feb. 14, 2008

(30) Foreign Application Priority Data

Mar. 11, 2005 (JP) ..... 2005-068495

(51) Int. Cl.
*F01N 13/08* (2010.01)

(52) U.S. Cl. ..... 181/239; 181/238; 181/251; 181/257; 181/268; 181/275

(58) Field of Classification Search ..... 181/238, 181/239, 251, 253, 254, 257, 268, 272, 273, 181/275, 240

See application file for complete search history.

(56) References Cited

U.S. PATENT DOCUMENTS

| | | | | | |
|---|---|---|---|---|---|
| 2,360,429 | A | * | 10/1944 | Leadbetter | 181/260 |
| 2,389,988 | A | * | 11/1945 | Leadbetter | 181/231 |
| 2,468,384 | A | * | 4/1949 | Tyskewicz | 181/240 |
| 2,498,979 | A | * | 2/1950 | Bourne | 181/260 |
| 2,692,025 | A | * | 10/1954 | Hamilton | 181/238 |
| 2,940,249 | A | * | 6/1960 | Reinhard | 60/313 |
| 3,114,430 | A | * | 12/1963 | Gallagher | 181/254 |

(Continued)

FOREIGN PATENT DOCUMENTS

| | | |
|---|---|---|
| JP | 7-310521 | 11/1995 |

(Continued)

*Primary Examiner*—Jeffrey Donels
*Assistant Examiner*—Jeremy Luks
(74) *Attorney, Agent, or Firm*—Kenyon & Kenyon LLP

(57) ABSTRACT

A variable muffler corresponds to a muffler of an internal combustion engine including a variable valve that controls the flow of exhaust gas. The variable muffler includes a muffler body forming a muffler chamber, an inlet pipe with an opening at the muffler chamber to direct the flow of exhaust gas from the opening towards the muffler chamber, and a muffler-in pipe arranged in the muffler chamber. The muffler-in pipe includes an opening facing the opening at the muffler chamber, and into which the exhaust gas output from the opening flows in a predetermined direction. The muffler-in pipe further includes a slope inclining vertically downwards towards the opening, and extending in a direction different from the predetermined direction. By such a configuration, a muffler of an internal combustion engine having proper driving of the valve ensured can be provided.

6 Claims, 6 Drawing Sheets

U.S. PATENT DOCUMENTS

| | | | | | |
|---|---|---|---|---|---|
| 3,419,107 | A | * | 12/1968 | Jozepaitis | 181/240 |
| 3,710,892 | A | * | 1/1973 | Hubbell, III | 181/266 |
| 4,064,963 | A | * | 12/1977 | Kaan et al. | 181/244 |
| 4,422,519 | A | * | 12/1983 | Nomura et al. | 180/219 |
| 4,449,608 | A | * | 5/1984 | Hirata et al. | 181/228 |
| RE31,989 | E | * | 9/1985 | Nomura et al. | 180/219 |
| 5,265,420 | A | * | 11/1993 | Rutschmann | 60/302 |
| 5,708,237 | A | | 1/1998 | Maeda et al. | |
| 5,971,098 | A | | 10/1999 | Suzuki et al. | |
| 2002/0088666 | A1 | * | 7/2002 | Bouffard | 181/231 |
| 2004/0003963 | A1 | * | 1/2004 | Worner et al. | 181/239 |

FOREIGN PATENT DOCUMENTS

| | | | | |
|---|---|---|---|---|
| JP | 08-246840 | A | | 9/1996 |
| JP | 09-032590 | A | | 2/1997 |
| JP | 9-52002 | | | 2/1997 |
| JP | 2000-054822 | A | | 2/2000 |
| JP | 2000-328935 | A | | 11/2000 |
| JP | 2002-004893 | A | | 1/2002 |
| JP | 2004058820 | A | * | 2/2004 |

* cited by examiner

MUFFLER OF INTERNAL COMBUSTION ENGINE

This is a 371 national phase application of PCT/JP2006/300681 filed 12 Jan. 2006, which claims priority of Japanese Patent Application No. 2005-068495 filed 11 Mar. 2005, the contents of which are incorporated herein by reference.

TECHNICAL FIELD

The present invention generally relates to a muffler of an internal combustion engine, and more particularly, a muffler of an internal combustion engine with a valve for controlling the flow of exhaust gas.

BACKGROUND ART

A conventional muffler of an internal combustion engine is disclosed in, for example, Japanese Patent Laying-Open No. 2000-54822, directed to reducing the size without degradation in the muffling performance. The muffler disclosed in this publication includes a control valve that opens when the pressure of the exhaust gas in the muffler chamber exceeds a predetermined level. A valve opening that communicates with the muffler chamber and a sheet-like valve capable of deformation and provided so as to close the valve opening, constitute the control valve.

Japanese Patent Laying-Open No. 9-32590 discloses a throttle valve device for an internal combustion engine, directed to allowing resin-molding of the throttle body and preventing freezing of the throttle valve. Japanese Patent Laying-Open No. 2002-4893 discloses a throttle body employing resin as the material, and directed to reliably preventing freezing with a simple configuration.

Japanese Patent Laying-Open No. 2000-328935 discloses an exhaust noise silencer for a vehicle, directed to obviating freezing of condensed water in the outlet pipe and preventing blocking of the exhaust system. The exhaust noise silencer disclosed in this publication includes an inlet pipe and an outlet pipe with a pipe portion formed inclined with respect to the horizontal level. The inlet pipe and outlet pipe each have an opening at individual chambers within the muffler, divided by a partition.

The muffler disclosed in the aforementioned Japanese Patent Laying-Open No. 2000-54822 has the control valve provided on the flowing path of exhaust gas to open/close corresponding to change in the pressure of the exhaust gas. A muffler provided with such a valve is disadvantageous in that condensed water of the exhaust gas remains in the proximity of the valve after the engine has been started. If the engine is then stopped and left under such a state, the condensed water will freeze at low temperature conditions such as during wintertime, leading to the possibility of malfunction in the valve.

DISCLOSURE OF THE INVENTION

In view of the foregoing, an object of the present invention is to provide a muffler of an internal combustion engine that has proper driving of the valve ensured.

A muffler of an internal combustion engine according to the present invention is provided with a valve that controls the flow of exhaust gas. The muffler of an internal combustion engine includes a housing forming an internal room, an inlet pipe having a first opening that opens at the internal room to direct the flow of exhaust gas output at the internal combustion engine towards the internal room through the first opening, and an internal duct arranged at the internal room. The internal duct includes a second opening that opens at the internal room and faces the first opening, and through which the exhaust gas output from the first opening flows in a predetermined direction. The internal duct further includes a slope inclined vertically downwards towards the second opening, and extending in a direction differing from the predetermined direction.

Since the slope extends in a direction differing from the predetermined direction in accordance with the muffler of the internal combustion engine configured as set forth above, the exhaust gas flowing into the second opening from the first opening collides against the internal wall of the internal duct at the slope. At this stage, the exhaust gas is cooled, whereby the water vapor in the exhaust gas is condensed into a liquid, i.e. condensed liquid. Since the slope inclines vertically downwards towards the second opening, the condensed liquid runs down the slope to be emitted into the internal room from the second opening. In accordance with the present invention, exhaust gas having the ratio of water vapor included therein greatly reduced is delivered to the site where the valve is disposed. Accordingly, generation of condensed liquid from exhaust gas at the site where the valve is disposed is suppressed to prevent disturbance of proper driving of the valve caused by freezing of condensed liquid.

Preferably, the lower end position of the mouth of second opening is located deviating from the mouth of the first opening, when viewed along the predetermined direction. In accordance with the muffler of an internal combustion engine configured as set forth above, disturbance of the flow of condensed liquid from the exhaust gas generated at the slope, when flowing from the second opening to the internal room, caused by the exhaust gas flowing from the first opening to the second opening, can be prevented. Thus, the condensed liquid from the exhaust gas can be emitted efficiently into the internal room.

Preferably, the internal duct is formed bending at the slope. In accordance with the muffler of an internal combustion engine configured as described above, the exhaust gas flowing from the first opening to the second opening further collides against the inner wall of the internal duct where the slope bends. Therefore, the ratio of water vapor included in the exhaust gas can be further reduced.

Further preferably, the inlet pipe is formed inclined vertically downwards towards the first opening. A trench is formed at the bottom of the inner wall of the inlet pipe. By such a configuration, the condensed liquid of the exhaust gas generated at the inlet pipe flows towards the first opening, and can be emitted into the internal room from the first opening. Since the condensed liquid is collected at the trench formed at the bottom of the inner wall, the flow of condensed liquid is facilitated.

The muffler of an internal combustion engine further includes a first outlet pipe having a valve provided on a conduit to emit exhaust gas from the internal room. Preferably, the first outlet pipe is formed inclined vertically downwards as becoming distant from the valve. A trench is formed at the bottom of the inner wall of the first outlet pipe. By such a configuration, the condensed liquid of exhaust gas at the first outlet pipe, when generated, can be made to flow farther away from the valve. Since the condensed liquid is collected at the trench formed at the bottom of the internal wall, the flow of condensed liquid is facilitated.

Further preferably, the housing includes a partition that divides the internal room into a first chamber where the first and second openings open, and a second chamber located vertically downward than the first chamber. The partition includes a hole establishing communication between the first chamber and the second chamber. The muffler of the internal combustion engine further includes a first outlet pipe having a valve provided on a conduit to emit exhaust gas from the first chamber, and a second outlet pipe emitting exhaust gas from the second chamber. The partition is formed inclining vertically downwards towards the hole from a site immediately below the first and second openings.

By such a structure, the condensed liquid falling on the partition from the first or second opening can be guided from the first chamber to the second chamber via the hole. Accordingly, the condensed liquid can be directed towards the second outlet pipe absent of a valve instead of the first outlet pipe provided with the valve.

In accordance with the present invention, a muffler of an internal combustion engine having proper driving of a valve ensured can be provided.

The foregoing and other objects, features, aspects and advantages of the present invention will become more apparent from the following detailed description of the present invention when taken in conjunction with the accompanying drawings.

BEST MODE FOR CARRYING OUT THE INVENTION

An embodiment of the present invention will be described hereinafter with reference to the drawings.

Figure 1:
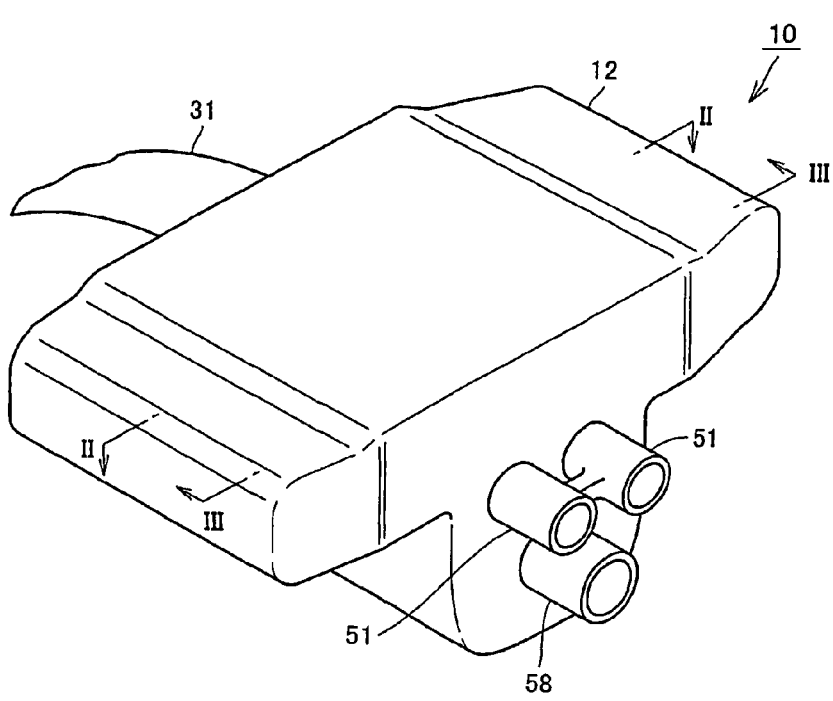
FIG. 1 is a perspective view of a variable muffler with a valve according to an embodiment of the present invention.

Referring to FIG. 1, a variable muffler 10 includes the main body of a muffler, i.e. a muffler body 12, an inlet pipe 31 connected to muffler body 12 at the front side of the vehicle, and also an outlet pipe 58 and two outlet pipes 51 with valves, connected to muffler body 12 at the rear side of the vehicle. Muffler body 12 is formed of a metal such as stainless steel or titanium. Inlet pipe 31 communicates with an internal combustion engine such as a gasoline engine or diesel engine. The two valve-added outlet pipes 51 extend in parallel spaced apart from each other in the horizontal direction.

Figure 2:
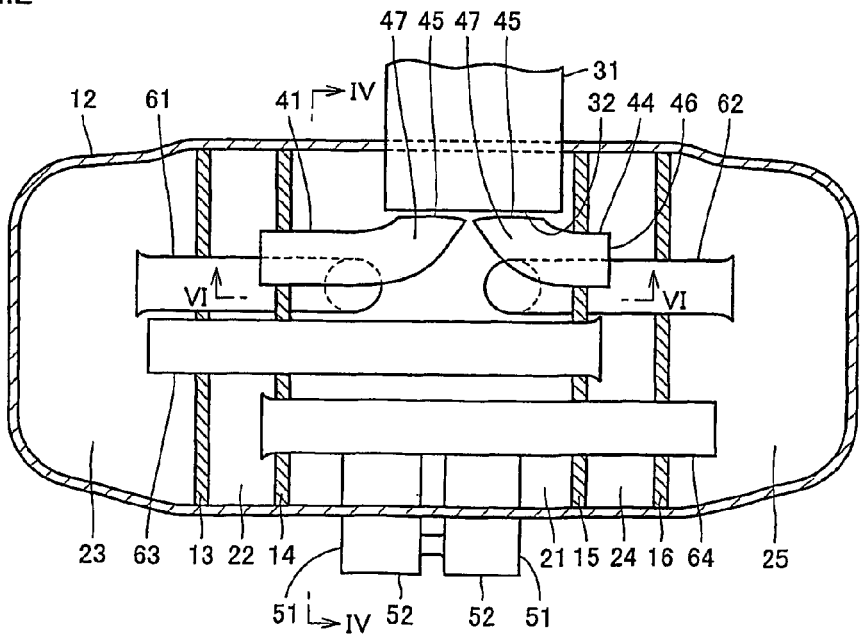
FIGS. 2 and 3 are sectional views of the variable muffler of FIG. 1 taken along lines II-II and III-III, respectively.
Figure 3:
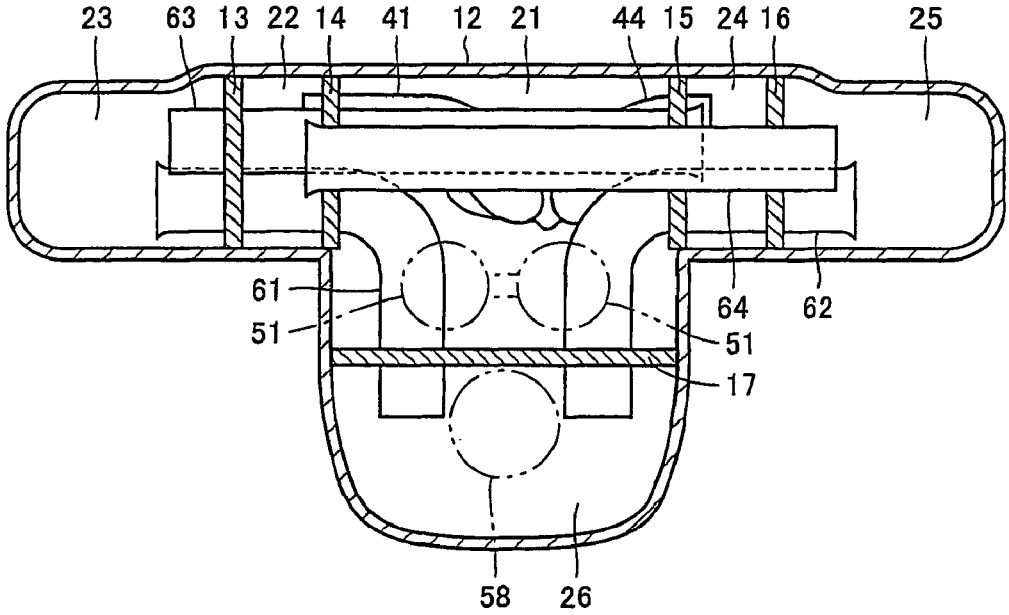
Figure 4:
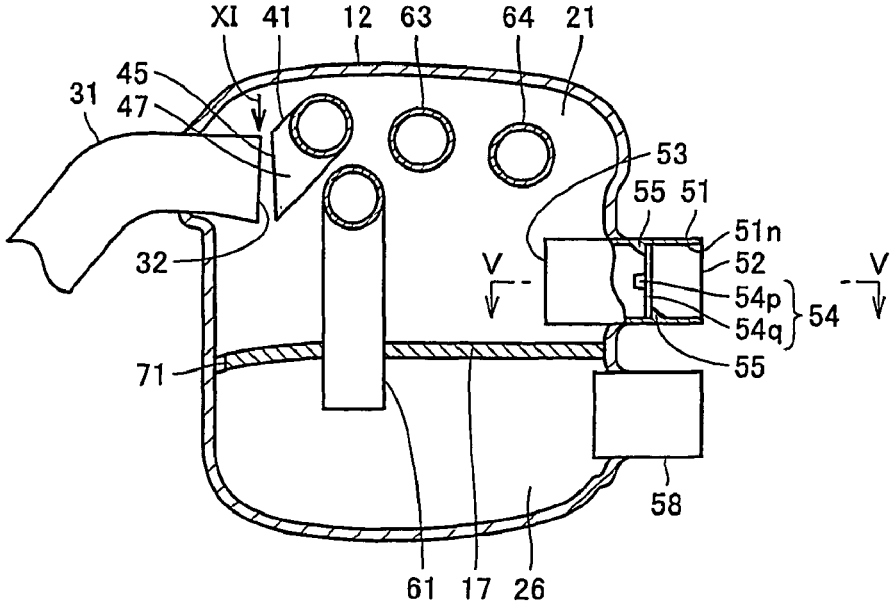
FIG. 4 is a sectional view of the variable muffler of FIG. 2 taken along line IV-IV.

Referring to FIGS. 2-4, muffler body 12 takes a housing configuration, and includes partitions 13-17. Partition 17 extending in the horizontal direction and partitions 14 and 15 extending in the vertical direction and spaced apart from each other constitute a muffler chamber 21. A muffler chamber 26 is located at the opposite side of muffler chamber 21 with respect to and adjacent to partition 17. Muffler chamber 26 is located vertically below muffler chamber 21.

Partitions 13 and 16 are provided apart from partitions 14 and 15, respectively. Between partitions 13 and 14 and between partitions 15 and 16 are formed muffler chambers 22 and 24, respectively, located at either side of muffler chamber 21. A muffler chamber 23 is located adjacent to partition 13 and at the opposite side of muffler chamber 22 with respect to partition 13. A muffler chamber 25 is located adjacent to partition 16, and at the opposite side of muffler chamber 24 with respect to partition 16.

Inlet pipe 31 and valve-added outlet pipes 51 are formed communicating with muffler chamber 21. Outlet pipe 58 is formed communicating with muffler chamber 26. Inlet pipe 31 and valve-added outlet pipes 51 do not necessarily have to open at the same muffler chamber, and may be formed opening at different muffler chambers communicating with each other.

Further, muffler-in pipes 41 and 42, and intermediate pipes 61 and 64 are disposed in muffler body 12. These pipes are arranged such that their entirety is accommodated in muffler body 12. Muffler-in pipe 41 is provided to establish communication between muffler chamber 21 and muffler chamber 22. Muffler-in pipe 44 is provided to establish communication between muffler chamber 21 and muffler chamber 24. Intermediate pipe 61 is formed to establish communication between muffler chamber 23 and muffler chamber 26. Intermediate pipe 62 is provided to establish communication between muffler chamber 25 and muffler chamber 26. Intermediate pipe 63 is provided to establish communication between muffler chamber 24 and muffler chamber 23. Intermediate pipe 64 is provided to establish communication between muffler chamber 22 and muffler chamber 25.

Figure 5:
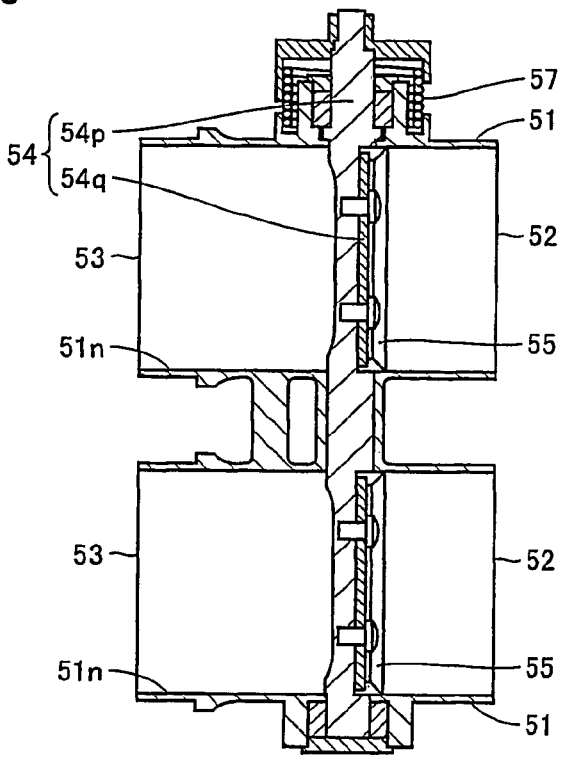
FIG. 5 is a sectional view of an outlet pipe with a valve taken along line V-V of FIG. 4.

Referring to FIGS. 4 and 5, valve-added outlet pipe 51 includes an opening 53 having the mouth located at muffler chamber 21, and an exhaust port 52 having the mouth located outside muffler body 12. Valve-added outlet pipe 51 extends from opening 53 towards exhaust port 52 in the longitudinal direction of the vehicle. Muffler body 12 is continuous with valve-added outlet pipe 51 between opening 53 and exhaust port 52. A variable valve 54 is provided on the conduit of valve-added outlet pipe 51, i.e. between opening 53 and exhaust port 52.

Variable valve 54 includes a valve shaft 54*p* extending so as to pierce the two valve-added outlet pipes 51 arranged in parallel, and a butterfly valve 54*q* secured to valve shaft 54*p* to open/close valve-added outlet pipe 51 in association with rotation of valve shaft 54*p*. Valve shaft 54*p* includes a coil spring 57 urging butterfly valve 54*q* in a predetermined direction, and an actuator not shown to rotatably drive butterfly valve 54*q* against the resilience of coil spring 57.

Valve-added outlet pipe 51 is formed with a valve stopper 55 protruding from an inner wall 51*n*. Butterfly valve 54*q* is urged by the resilience of coil spring 57 to form close contact with valve stopper 55. At this stage, variable valve 54 corresponds to a closed state, and the flow of exhaust gas in valve-added outlet pipe 51 is cut. By such a configuration of close contact between butterfly valve 54*q* and valve stopper 55, sound leakage from valve-added outlet pipe 51 can be reduced effectively. When valve shaft 54*p* is rotated by the actuator, a gap is formed between butterfly valve 54*q* and valve stopper 55. At this stage, variable valve 54 corresponds to an open state, allowing the flow of exhaust gas in valve-added outlet pipe 51.

The actuator that rotatably drives butterfly valve 54*q* includes, for example, a motor and a wire having both ends fixed to the motor and valve shaft 54*p*. The usage of such an actuator allows butterfly valve 54*q* to be positioned with an appropriate inclination, as compared to the case using a valve mechanism that is driven by the exhaust pressure. Accordingly, the flow of the exhaust gas within valve-added outlet pipe 51 can be controlled finely. Further, the maximum flow of the exhaust gas into valve-added outlet pipe 51 can be increased since butterfly valve 54*q* can be rotated to a position parallel to the flow of the exhaust gas.

In the case where such an actuator is to be employed, the actuator must be externally provided to valve-added outlet pipe 51. Therefore, variable valve 54 is provided outside muffler body 12 in the present embodiment. Specifically, variable valve 54 is located between the site where muffler body 12 is continuous with valve-added outlet pipe 51 and the site of exhaust port 52. Therefore, variable valve 54 will be exposed to the atmosphere of low temperature such as during a cold period or wintertime.

Figure 6:
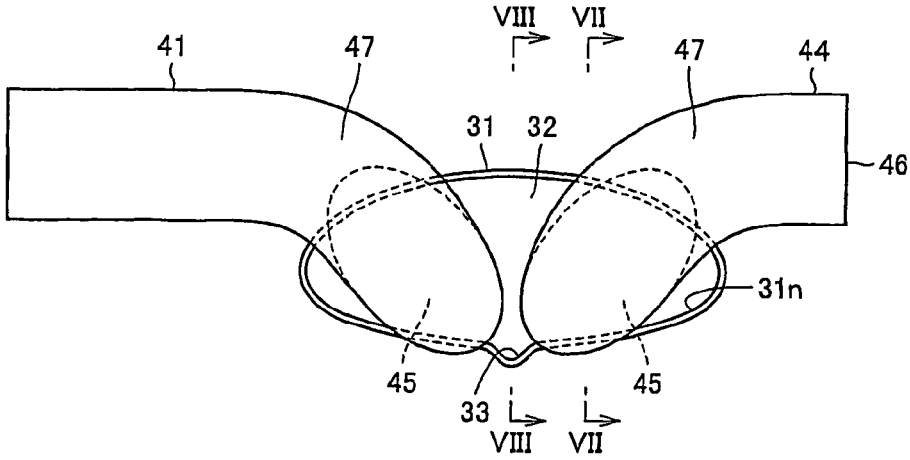
FIG. 6 is a front view of an inlet pipe and a muffler-in pipe taken along line VI-VI of FIG. 2.
Figure 7:
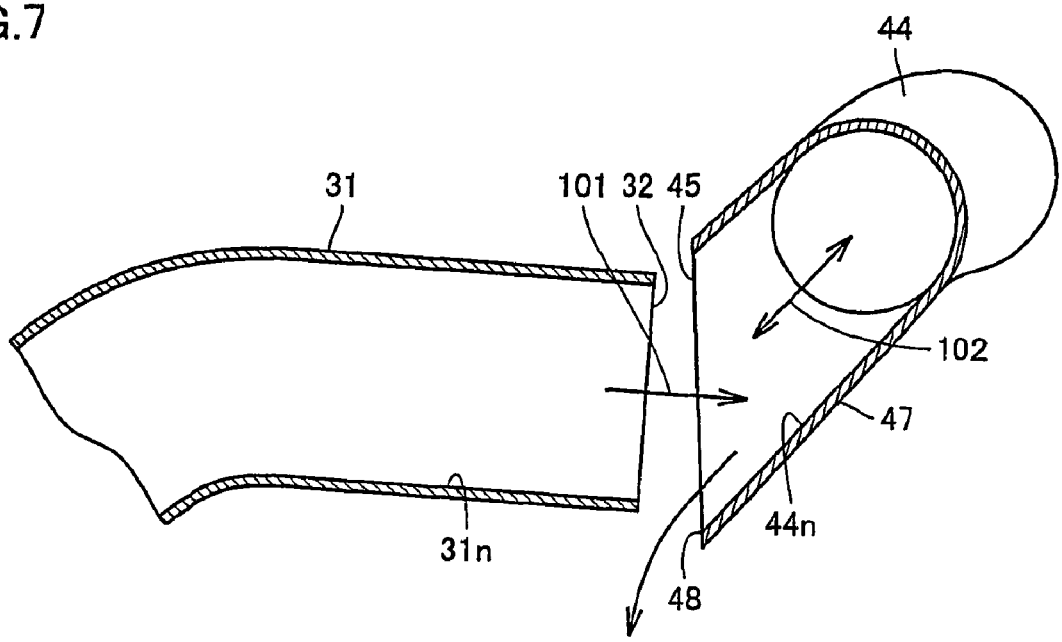
FIGS. 7 and 8 are sectional views of the inlet pipe and muffler in-pipe of FIG. 6 taken along lines VII-VII and VIII-VIII, respectively.

Referring to FIGS. 2, 6 and 7, inlet pipe 31 includes an opening 32 that opens towards the rear side of the vehicle in muffler chamber 21. Opening 32 has the mouth located distant from partition 17 in the vertically upward direction. Opening 32 opens in a substantially ellipse shape with the major axis in the horizontal direction and the minor axis in the vertical direction. Opening 32 corresponds to the site where the exhaust gas output from the internal combustion engine is initially emitted into muffler body 12. In other words, opening 32 is located most upstream of the exhaust gas flow passing through the muffler chambers in muffler body 12. Inlet pipe 31 extends so as to incline vertically downwards towards opening 32 for a predetermined length.

Muffler-in pipe 44 includes an opening 45 with the mouth located at muffler chamber 21 towards the front side of the vehicle, and an opening 46 with the mouth located at muffler chamber 24 in a direction different from that of opening 45, specifically differing in a direction of 90° in the present embodiment. Opening 45 has the mouth located distant from partition 17 in the vertically upward direction. Opening 45 faces opening 32 of inlet pipe 31 in the longitudinal direction of the vehicle. The direction in which openings 45 and 32 face each other is not limited to the longitudinal direction of the vehicle, and may be in another direction.

By such a configuration, the exhaust gas output from the internal combustion engine and flowing in inlet pipe 31 is directed towards opening 45 from opening 32, in the direction indicated by arrow 101 in FIG. 7. The flowing direction of the exhaust gas into opening 45 is identified, for example, by detecting the flowing direction of the exhaust gas at the center of opening 45.

In the present embodiment, the flowing direction of the exhaust gas into opening 45 coincides with the extending direction of inlet pipe 31 towards opening 32. The flowing direction of the exhaust gas into opening 45 substantially coincides with the longitudinal direction of the vehicle. The cross section area of muffler chamber 21 is larger than the cross section area of inlet pipe 31 based on a plane cut in a direction orthogonal to the flowing direction of exhaust gas from opening 32 to opening 45.

Muffler-in pipe 44 includes a slope 47 formed over a predetermined length from opening 45. Slope 47 is formed inclining vertically downwards towards opening 45. Specifically, slope 47 is formed such that the distance from the ground becomes smaller in proportion to approaching opening 45. Slope 47 extends in a direction crossing the flowing direction of exhaust gas into opening 45 (the direction indicated by arrow 102 in FIG. 7). An inner wall 44*n* of muffler-in pipe 44 extends in a direction at slope 47 differing from the flowing direction of the exhaust gas into opening 45. Slope 47 may be formed, not only at a portion of muffler-in pipe 44, but also at the entire portion of muffler-in pipe 44.

Slope 47 is formed bending at a site distant from opening 45. Slope 47 includes a region extending from the center area to the rear side of the vehicle while extending to the lateral side of the vehicle over a predetermined length from opening 45, and a region extending simply from the center area to the lateral side of the vehicle. The bent of slop 47 is located between these two regions. Slope 47 extends in a smooth curved manner.

The lower end 48 of opening 45 (the portion located most vertically down at the edge of opening 45) is located deviating from the mouth of opening 32, when viewing openings 32 and 45 along the flowing direction of the exhaust gas into opening 45. In the present embodiment, lower end 48 is located deviating from the mouth of opening 32 in the vertically downward direction, when the mouth of opening 32 is projected onto the mouth plane of opening 45 along the flowing direction of exhaust gas into opening 45.

Although the description set forth above is based on the configuration of muffler-in pipe 44, muffler-in pipe 41 similarly includes an opening 45 and a slope 47, and is formed to have a shape similar to that of muffler-in pipe 44.

Variable muffler 10 configured as set forth above is adapted to set variable valve 54 at a closed state in order to reduce the exhaust sound during cruising through town or at the time of high speed cruising (for example, cruising at the constant speed of 100 km). Accordingly, the flow of exhaust gas in valve-added outlet pipe 51 is cut. The exhaust gas flows from inlet pipe 31 to muffler-in pipe 41, muffler chamber 22, intermediate pipe 64, muffler chamber 25, intermediate pipe 62, and then into muffler chamber 26, or from inlet pipe 31 to muffler-in pipe 44, muffler chamber 24, intermediate pipe 63, muffler chamber 23, intermediate pipe 61, and then into muffler chamber 26. Finally, the exhaust gas is emitted outside the vehicle from muffler chamber 26 through outlet pipe 58.

In the present embodiment, slope 47 is formed extending in a direction crossing the flowing direction of the exhaust gas into opening 45. Therefore, the exhaust gas flowing into opening 45 from opening 32 first collides against inner wall 44*n* of muffler-in pipes 41 and 44 at slope 47. Since slope 47 is formed bending partway, the exhaust gas changes its direction of travel while flowing along inner wall 44*n*. Therefore, the exhaust gas will be cooled down abruptly by forming contact with the internal wall 44*n* of muffler-in pipes 41 and 44 through its flow along slope 47. Accordingly, the exhaust gas is saturated, whereby condensed liquid is generated at slope 47.

The exhaust gas output from the internal combustion engine passes through a narrow conduit and is then initially released into the space of muffler chamber 21 from opening 32 of inlet pipe 31. At this stage, the heat of the exhaust gas is output at a burst into muffler chamber 21. Therefore, the exhaust gas is under a condition where condensed liquid is easily generated at the region from inlet pipe 31 towards muffler-in pipes 41 and 44. By arranging slope 47 qualified as a mechanism of cooling down the exhaust gas more aggressively at that site, the water vapor in the exhaust gas can be extracted as condensed liquid more effectively.

At slope 47, inner wall 44*n* of muffler-in pipes 41 and 44 may be formed with irregularity. In this case, the exhaust gas can be cooled down further effectively since the area of contact between inner wall 44*n* and the exhaust gas is increased.

Since slope 47 extends inclining vertically downwards towards opening 45, the condensed liquid runs along inner wall 44*n* to fall on partition 17 from lower end 48. Since lower end 48 is located deviating from the mouth of opening 32 in the vertically downward direction, the flow of the condensed liquid will not be disturbed by the exhaust gas flowing from opening 32 to opening 45. Accordingly, the condensed liquid can be collected efficiently on partition 17.

When not running through the town or in a mode other than a high speed cruising mode, variable valve 54 is set to an open state. At this stage, the exhaust gas is discharged from the vehicle through valve-added outlet pipe 51 with precedence. Accordingly, the exhaust efficiency can be improved to obtain high power.

Figure 8:
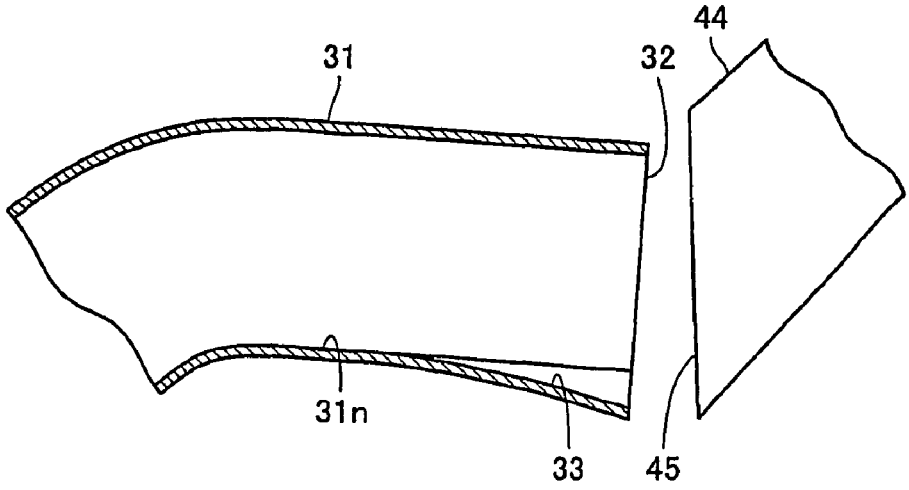

Referring to FIGS. 6 and 8, an inner wall 31*n* of inlet pipe 31 includes a trench 33 located at the vertical bottom side of the cross section of inlet pipe 31. Trench 33 is formed at the extending portion of inlet pipe 31 inclining vertically downwards. By such a configuration of inlet pipe 31, the condensed liquid generated in inlet pipe 31 can be directed towards opening 32 while being collected at trench 33. Accordingly, the condensed liquid can be collected efficiently on partition 17.

Figure 9:
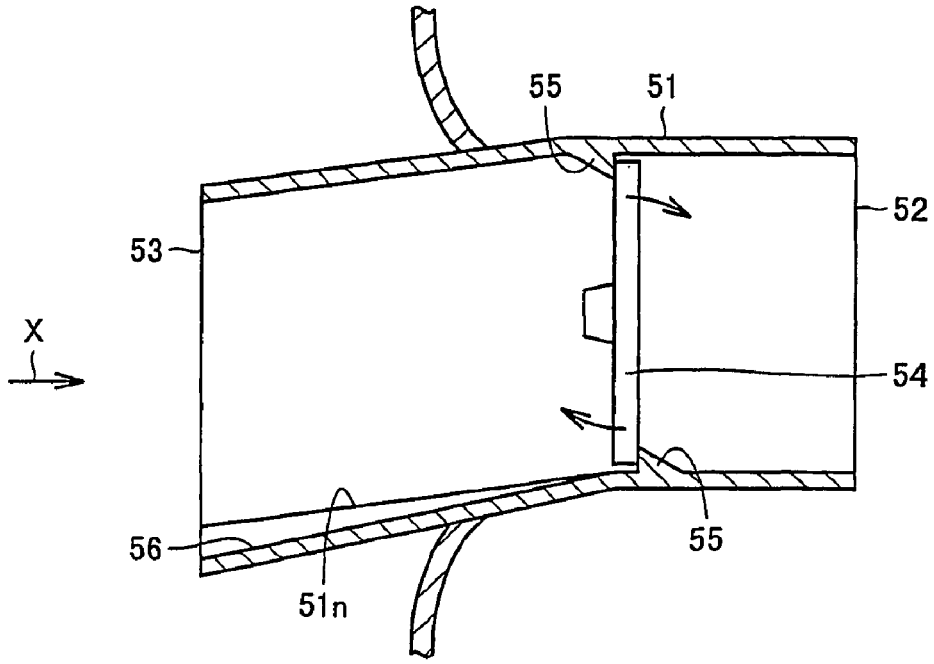
FIG. 9 is an enlarged sectional view of the outlet pipe with a valve of FIG. 4.
Figure 10:
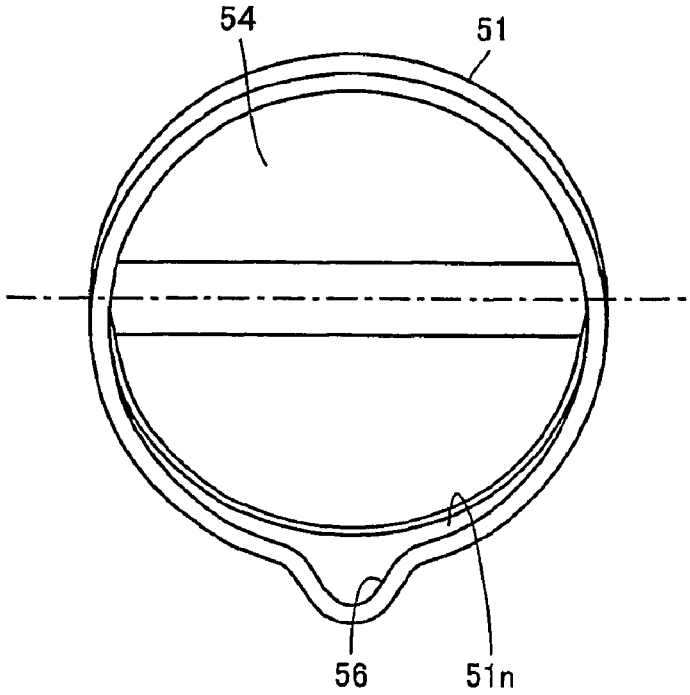
FIG. 10 is a sectional view of the outlet pipe with a valve of FIG. 9, viewed in the direction from arrow X.

Referring to FIGS. 9 and 10, valve-added outlet pipe 51 extends inclining vertically downward towards opening 53 from variable valve 54. An inner wall 51*n* of valve-added outlet pipe 51 includes a trench 56 located at the vertical bottom side of the cross section of valve-added outlet pipe 51. Trench 56 is formed at a position where outlet pipe 51 extends inclining vertically downwards. By such a configuration, the condensed liquid generated in valve-added outlet pipe 51 can be directed towards opening 53 while being collected at trench 56.

Valve-added outlet pipe 51 extends in an inclination manner vertically downwards towards exhaust port 52 from variable valve 54. The trench can be formed at that inclining extending position.

Figure 11:
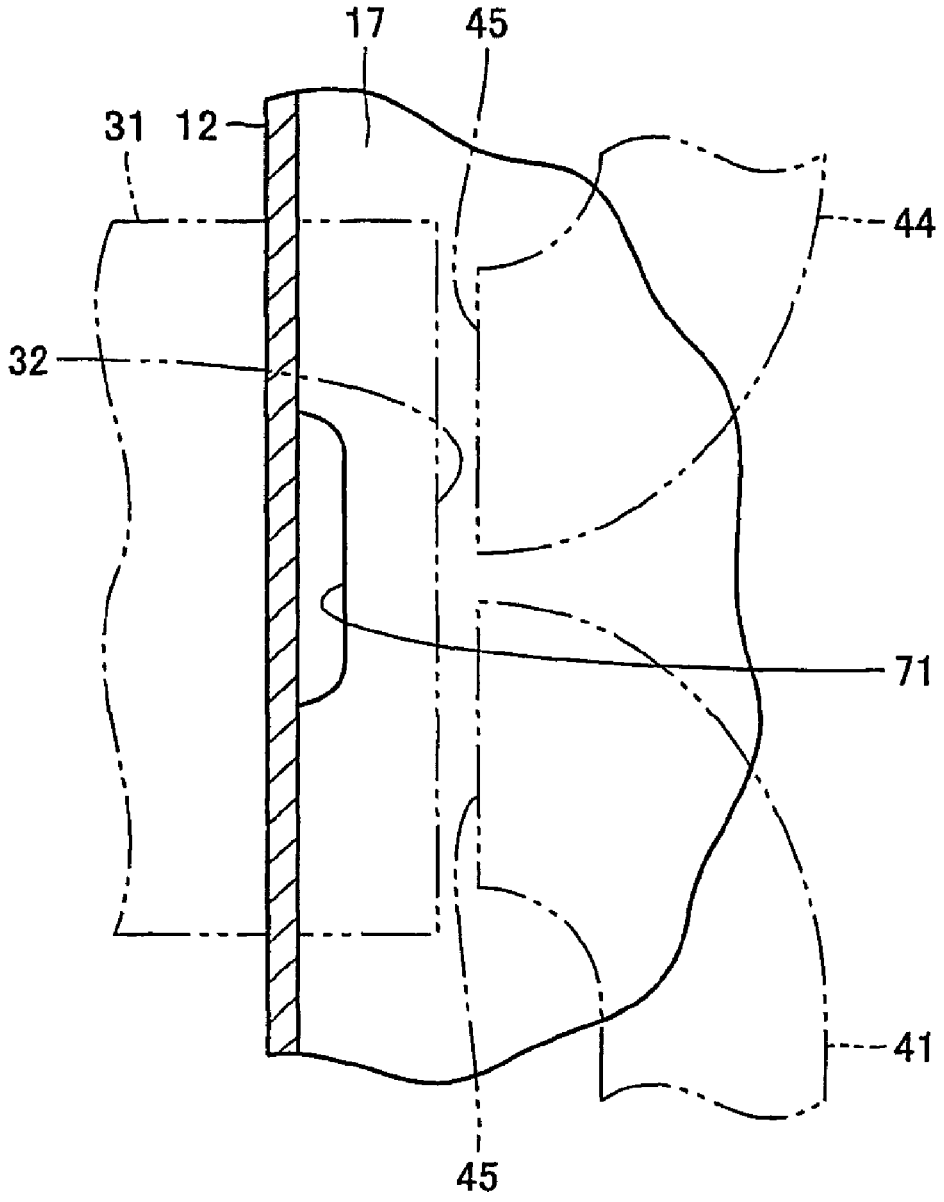
FIG. 11 is a top plan view of the interior of the muffler main body, viewed in the direction from arrow XI of FIG. 4.

Referring to FIGS. 4 and 11, a hole 71 is formed at a site of partition 17 adjacent to muffler body 12. Hole 71 establishes communication between muffler chamber 21 and muffler chamber 26. Partition 17 is formed inclining vertically downwards towards hole 71 from a site immediately below the site where opening 32 of inlet pipe 31 faces openings 45 of muffler-in pipes 41 and 44.

By such a configuration, the condensed liquid falling on partition 17 from inlet pipe 31 and muffler-in pipes 41 and 44 flows towards hole 71 to be introduced into muffler chamber 26 via hole 71. Then, the condensed liquid is output outside the vehicle through outlet pipe 58 absent of a valve.

Variable muffler 10 identified as a muffler of an internal combustion engine according to an embodiment of the present invention is provided with a variable valve 54 as the valve to control the flow of exhaust gas. Variable muffler 10 includes a muffler body 12 identified as a housing forming muffler chamber 21 corresponding to an internal room, an inlet pipe 31 identified as an inlet pipe having an opening 32 identified as the first opening with the mouth located at muffler chamber 21 to direct the flow of the exhaust gas output from the internal combustion engine towards muffler chamber 21 from opening 32, and muffler-in pipes 41 and 44 identified as the internal duct arranged in muffler chamber 21.

Muffler-in pipes 41 and 44 each include an opening 45 identified as the second opening having the mouth facing opening 32 at muffler chamber 21, and into which the exhaust gas output from opening 32 flows in a predetermined direction (the direction indicated by arrow 101). Muffler-in pipes 41 and 44 further include a slope inclining vertically downwards towards opening 45, and extending in a direction different from the predetermined direction.

In accordance with variable muffler 10 of the embodiment of the present invention configured as set forth above, the water vapor included in the exhaust gas can be condensed aggressively into a liquid at slope 47 when variable valve 54 is set at a closed state. Therefore, exhaust gas mainly constituted of the gas component arrives at valve-added outlet pipe 51. Accordingly, generation of the condensed liquid of the exhaust gas in valve-added outlet pipe 51 can be suppressed to prevent the condensed liquid from being left at the site where close contact is established between valve stopper 55 and butterfly valve 54*q*.

The present embodiment is advantageous in that the possibility of valve stopper 55 and butterfly valve 54*q* being freezed by the condensed liquid is eliminated even in the case where the engine is started during a cold period or wintertime, and then stopped. Thus, variable valve 54 can be driven always properly to allow sufficient exhibition of the quietness of the vehicle and the running performance at an appropriate timing.

Although the present invention has been described and illustrated in detail, it is clearly understood that the same is by way of illustration and example only and is not to be taken by way of limitation, the spirit and scope of the present invention being limited only by the terms of the appended claims.

INDUSTRIAL APPLICABILITY

The present invention is mainly applicable to a muffler of an internal combustion engine such as a gasoline engine or diesel engine.

The invention claimed is:

1. A muffler of an internal combustion engine including a valve that controls a flow of exhaust gas, comprising:

a housing forming an internal room, an inlet pipe including a first opening that opens at said internal room for directing exhaust gas output from the internal combustion engine towards said internal room from said first opening, and an internal duct arranged in said internal room, including a second opening having a mouth located at said internal room facing said first opening, and into which the exhaust gas output from said first opening flows in a predetermined direction, wherein said internal duct further includes a slope inclining vertically downwards towards said second opening, and extending in a direction differing from said predetermined direction, and wherein a lower end of a mouth of said second opening is located deviating from the mouth of said first opening when viewed along said predetermined direction.

2. The muffler of an internal combustion engine according to claim 1, wherein said internal duct is formed bending at said slope.

3. The muffler of an internal combustion engine according to claim 1, wherein said inlet pipe is formed inclining vertically downwards towards said first opening, and has a trench formed at a bottom of an internal wall of said inlet pipe.

4. The muffler of an internal combustion engine according to claim 1, further comprising a first outlet pipe having said valve provided on a conduit for emitting exhaust gas from said internal room, wherein said first outlet pipe is formed inclining vertically downwards as becoming distant from said valve, and has a trench formed at a bottom of an inner wall of said first outlet pipe.

5. The muffler of an internal combustion engine according to claim 1, wherein said housing includes a partition dividing said internal room into a first chamber where said first and second openings open, and a second chamber located vertically downwards than said first chamber, said partition having a hole formed to establish communication between said first chamber and said second chamber, said muffler further comprising: a first outlet pipe having said valve provided on a conduit for emitting exhaust gas from said first chamber, and a second outlet pipe emitting exhaust gas from said second chamber, wherein said partition is formed inclining vertically downwards towards said hole from a site immediately below said first and second openings.

6. The muffler of an internal combustion engine according to claim 1, wherein said second opening having the mouth is located at said internal room directly in front of said first opening so that the exhaust gas flowing from the first opening to the second opening can collide against an inner wall of the internal duct in a predetermined direction.

* * * * *